United States Patent [19]

Fuller et al.

[11] 4,446,973

[45] May 8, 1984

[54] DISPLAY SYSTEM FOR STIFF FLAT SAMPLES

[76] Inventors: Robert T. Fuller, 1351 Empire St., Anaheim, Calif. 92804; Robert J. Sanders, 2200 E. Oskosh Cir., Anaheim, Calif. 92806

[21] Appl. No.: 298,910

[22] Filed: Sep. 2, 1981

[51] Int. Cl.[3] ..... A47F 7/16

[52] U.S. Cl. ..... 211/45; 211/163

[58] Field of Search ..... 211/45, 47, 163, 165, 211/166; 108/94

[56] References Cited

U.S. PATENT DOCUMENTS

| | | | |
|---|---|---|---|
| 978,670 | 12/1910 | Solomon | 211/163 |
| 1,265,016 | 5/1918 | William | 211/163 |
| 1,327,581 | 1/1920 | Yeats | 211/163 |
| 2,213,677 | 9/1940 | Miller | 211/163 |
| 2,614,698 | 10/1952 | Bell | 211/163 |
| 3,709,374 | 1/1973 | David | 211/163 |
| 3,984,002 | 10/1976 | Howard | 211/45 |
| 4,014,507 | 3/1977 | Swenson | 248/354 P X |

FOREIGN PATENT DOCUMENTS

| | | | |
|---|---|---|---|
| 6206 | 11/1894 | Sweden | 211/45 |
| 989472 | 4/1965 | United Kingdom | 211/163 |

*Primary Examiner*—William E. Lyddane
*Assistant Examiner*—Peter A. Aschenbrenner
*Attorney, Agent, or Firm*—Donald D. Mon

[57] ABSTRACT

A stand to hold and display pieces of flat material such as carpet samples. The stand includes an upright spindle and a sample support structure. The sample support structure includes a support ring and a spreader or series of spreaders below the ring. The spreader projects radially outward beyond the support ring. Attachment devices releasably join the samples to the support ring and have a substantial dimension of length which allows the samples to hang so as freely to rest against each other and against the spreader in a shingled and spread-out relationship.

10 Claims, 19 Drawing Figures

DISPLAY SYSTEM FOR STIFF FLAT SAMPLES

Field of the Invention

This invention relates to stands for displaying flat samples.

Background of the Invention

The display of flat samples at the point of sale has a considerable economic impact on the merchant, especially on a seller of floor coverings such as carpets. Not only are there many types of basic fabrics and patterns, but within each basic group there are many colors. The number of samples required to represent one group is quite large, and when it is multiplied by a number of groups, the physical task of adequately displaying the bulk of material available for sale is overwhelming.

It is axiomatic that unless the customer can see the sample, and in a way that attracts him, a sale is very difficult to make. The technique of providing samples in large books is an example of a common way of doing business, with difficulty. First, the potential purchaser must be willing to lift and sort through a number of books which are usually scattered around the floor. Then he must be willing to leaf through a selected book to try to find something attractive to him. Then the task of comparing a number of potentially acceptable materials requires still further dexterity, endurance, and determination. These are serious impediments to making sales.

Attempts have been made to provide display structures wherein samples could be handled more expeditiously. Two examples are shown in U.S. Pat. Nos. 4,063,648 and 4,119,207. In these patents, various types of frames, mountings and stands are shown. While these minimize the floor area required for a display, their capacity for numbers of samples is still limited, and the presentation to the customer is less than optimal.

For example, in the so-called "waterfall" display, where a stack of samples is shingled and slanted, the customer can see the narrow edge area of many samples. However, the samples are stacked one atop the other, and to reach any sample except the top one, a number of them must be folded back, which requires a considerable exertion. Furthermore, the weight of the samples above each sample tends to crush the pile. An experienced salesman attempts to correct for this by brushing the sample with his hand before the customer has a good look at it, because the crushed pile does not show the carpet to good advantage. This feature is a serious drawback to all displays where the samples are in a stack. Also, to remove samples from stacks for comparison is extremely difficult. It takes a most persistent customer and salesman to pursue comparisons.

As the cost of rent rises, it is increasingly important to pack more samples into less floor space. Wall units and waterfall units continue to have an important place in the display world, but the floor in the room offers a useful display area whose usage should be optimized and is often wasted. It is no longer so acceptable to load this area with rolls of carpet or stacks of books.

It is an object of this invention to provide a stand which packs a maximum number of samples into a unit of floor space, which makes every sample visible at least in part, and which gives quick, nearly effortless, access to every sample. A sample may readily be pulled out for examination and comparison, even without removing it from the display stand, and if desired can easily be removed from the stand. Weight exerted by contiguous samples is minimized to the point where pile crushing is no longer of concern.

It is another object of the invention to provide (if desired) multiple tiers of displayed samples, and also to simultaneously accept samples of various sizes.

Brief Description of the Invention

This invention includes an upright spindle and a sample support structure. The sample support structure includes a support ring and at least one spreader. The spreader is below the support ring, and projects radially beyond it. Attachment means attaches samples to the mounting ring so that they can hang down in a shingled and spaced-out array where they are readily viewed and easily pulled out of the array for closer examination and possible removal.

According to a preferred but optional feature of the invention, the spreader is also a ring.

According to yet another optional feature, the support structure can be motorized so as to be turned around the spindle.

The above and other features of the invention will be fully understood from the following detailed description and the accompanying drawings, in which:

Figure 1:
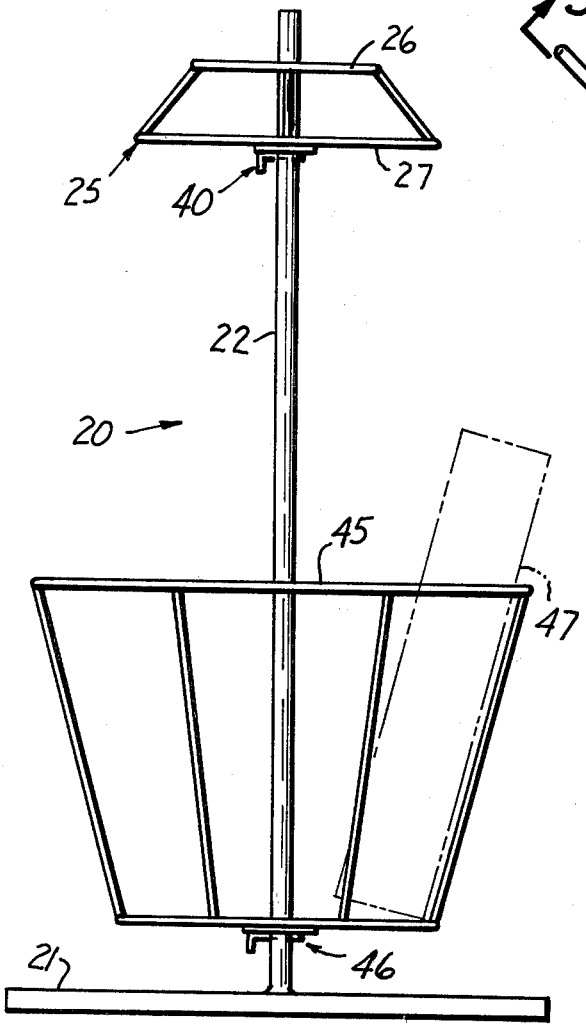
FIG. 1 is a side elevation of one embodiment of the invention.

A display stand 20 according to the invention is shown in FIG. 1. For a free standing installation, a base 21 will be provided. A central post hereinafter referred to as a "spindle" 22 is mounted to the base and rises therefrom. It is evident that this spindle could instead be wall mounted, or be mounted to different types of bases.

However, a circular or multi-legged floor base will most frequently be used.

A sample support structure 25 is rotatably mounted to the spindle. It comprises a support ring 26 and a spreader means 27. The spreader means is preferably also in the shape of a ring, although if desired it could instead be provided as a sheet formed into the shape of a frustum of a cone. In any event, the spreader means is located beneath and is spaced from the support ring and projects radially beyond it.

Figure 7:
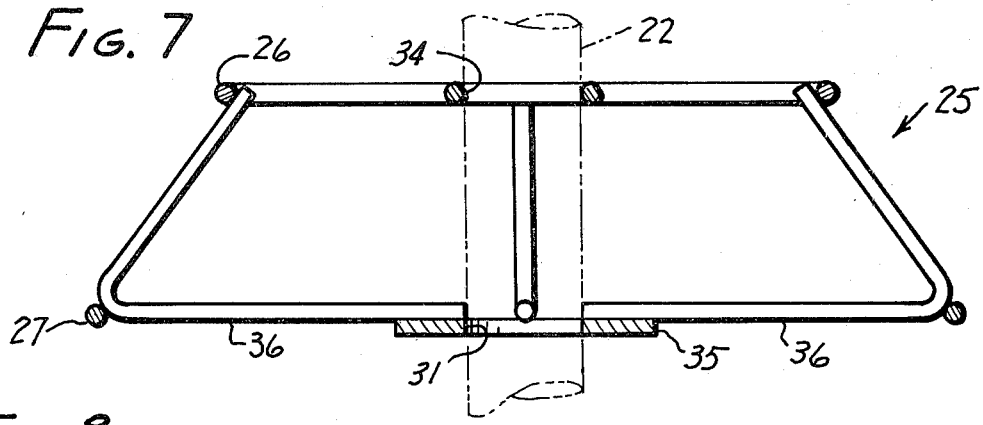
FIG. 7 is an axial section taken at line 7—7 in FIG. 9.

The sample support structure is supported by the spindle. The structure can be made simply and inexpensively from bent rod or wire, appropriately spot welded together. This construction is best shown in FIGS. 7, 8, and 9.

Bearing means 30, 31 are formed respectively at an upper and lower level, axially spaced-apart from one another so as to embrace the spindle and give lateral support against substantial tipping movement. As best seen in FIG. 9, the upper bearing means 30 may be formed of two pieces of rod 32, 33 bent so as to form an aperture 34 within which the spindle fits.

Figure 8:
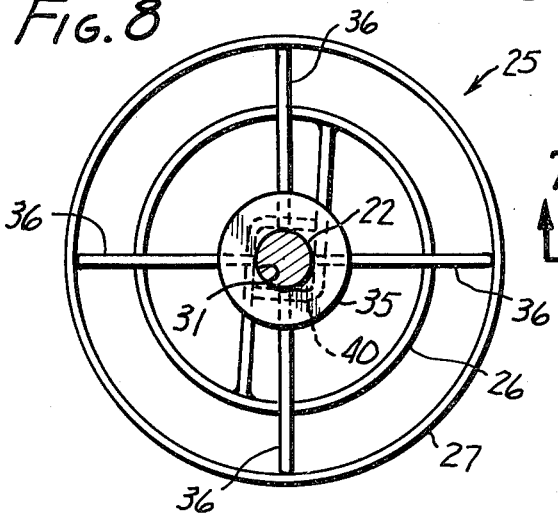
FIGS. 8 and 9 are respectively bottom and top views in FIG. 7.
Figure 9:
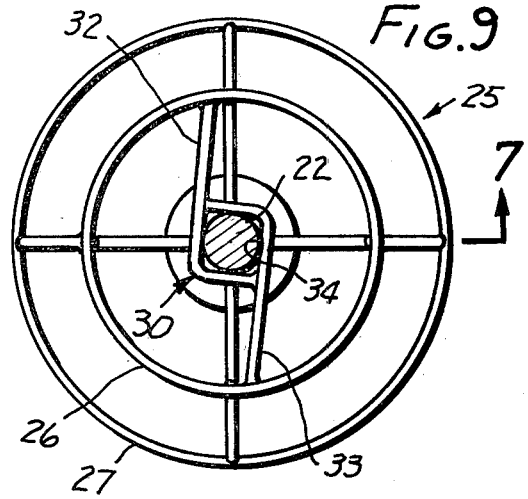

Lower bearing means 31 is best shown in FIG. 8. It is a circular disc 34 with an aperture 35 which closely embraces the spindle. The disc is spot welded to cross rods 36. Its lower surface constitutes a portion of a stop means 40 to retain the support structure 25 at a selected elevation. The other portion of stop means 40 is a cross pin 41 (FIG. 10) which passes through a hole in the spindle and projects beyond it to be engaged by the lower surface of disc 34.

It will be seen that the sample support structure 25 is supported at a selected elevation and is freely rotatable on the spindle.

Rotatability is not a requirement of this invention, although it is very desirable. In fact, a motor (not shown) can be mounted to the spindle and engaged to the support structure to rotate it on demand.

The support structure can be multiplied as many times as desired, placed one above the other on the same spindle and supported by respective stop means. They can be of the same or different dimensions as the one shown.

The invention also offers the opportunity to provide a basket 45 which is supported by the spindle and rests on stop means 46 at a selected elevation. It can be used to hold larger rolled samples 47 than would ordinarily be held by the support structure 25. This enables the same display to be used for many smaller samples of various colors and textures while the basket can provide storage for a larger sample which a purchaser might wish to see in order to appreciate what a larger piece of the material will look like.

Figure 2:
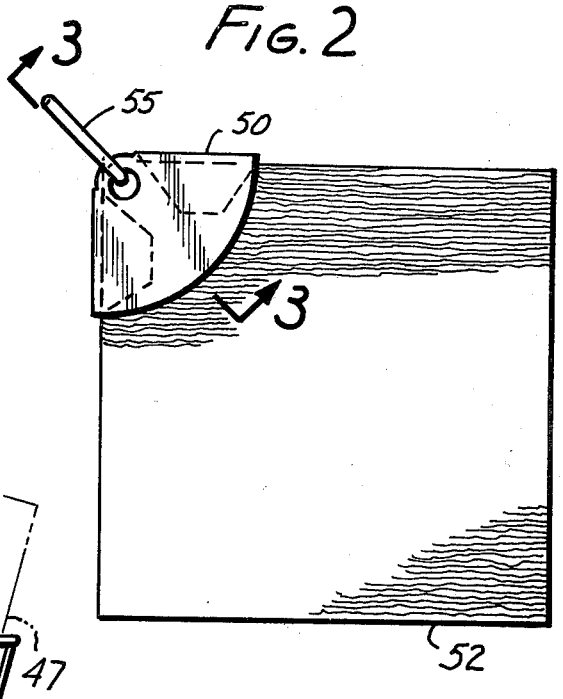
FIG. 2 is a top plan view of a sample to be displayed, together with one embodiment of attachment means.
Figure 3:
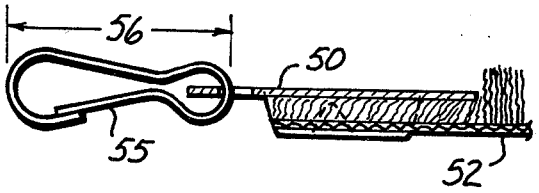
FIG. 3 is a cross-section taken at line 3—3 in FIG. 2.
Figure 4:
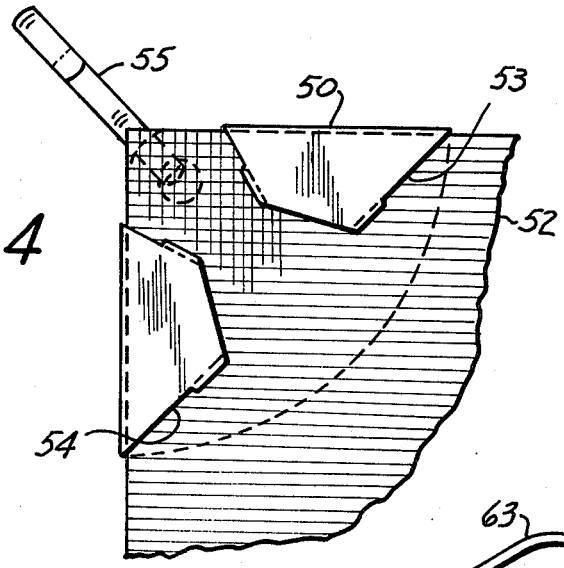
FIG. 4 is a bottom view of FIG. 2.

One embodiment of useful attachment means 50 is shown in FIGS. 2 and 3. In this embodiment a corner reinforcement 51 is attached to sample 52. As can be seen in FIG. 4, it is crimped over two edges by two folds 53, 54 and is attached to the sample such as by points or other piercing means. A hole is formed in the corner reinforcement and receives the attachment means which is in the form of a loop shaped fastener 55 with a substantial dimension of length 56. The fastener is a "safety pin" type clip which can be opened to enable it to be passed through hole 55, and which then can be hooked over the mounting ring and closed. This will support the sample on the mounting ring so that it can hang from the mounting ring and rest against the spreader means.

Figure 5:
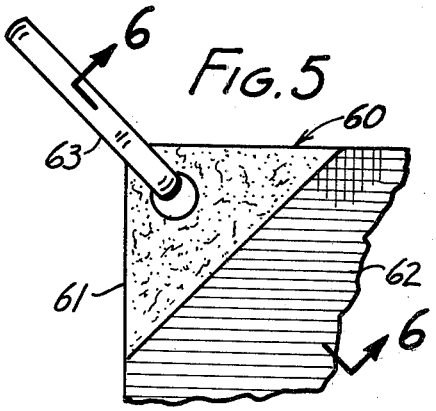
FIG. 5 is a partial top view showing another embodiment of attachment means.
Figure 6:
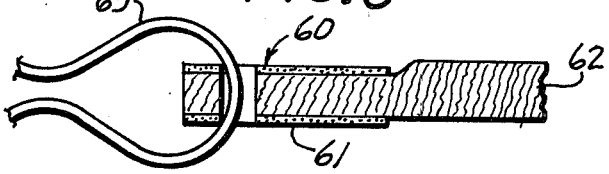
FIG. 6 is a cross-section taken at line 6—6 in FIG. 5.

FIG. 5 shows another embodiment of attachment means 60 which differs from attachment means 50 only in that the corner reinforcement 61 fits snugly over the corner without attachment tabs. It may be glued, stapled or otherwise fixed to the sample 62. A loop-shaped fastener 63 is shown which is the same as fastener 55.

Figure 12:
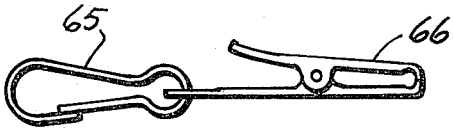
FIG. 12 is a side view of the presently-preferred embodiment of attachment means.

Another embodiment of attachment means is shown in FIG. 12 where a loop-shaped fastener 65 identical to fastener 55 is shown, but which instead of being applied directly to the sample carries an alligator-type clip 66 which can be opened to receive an edge of the sample, and closed to seize on it. This will enable the sample readily to be detached without having also to remove it from the support ring.

Figure 10:
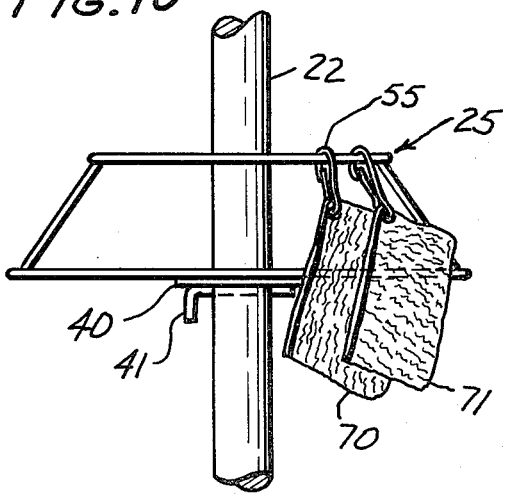
FIG. 10 is a side view showing samples attached to the display device of FIG. 1.
Figure 11:
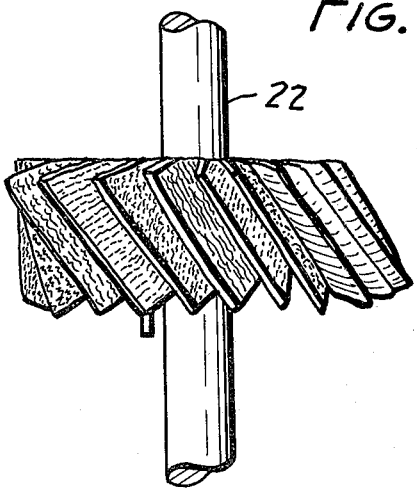
FIG. 11 is a side view showing disadvantages which can result if certain features of the invention are not used.

The use of the support structures so far disclosed is shown in FIG. 10, where a plurality of samples 70, 71 are shown hanging from the support ring. These are in shingled and overlaying relationship, and a portion of each can readily be seen. It will be understood that these two samples are illustrative of many others which can be placed completely around the support ring. They can reaadily be detached from and reattached to the support ring, even more conveniently when the attachment means of FIG. 12 is used. A substantial length of fastener provides a considerable degree of freedom in handling and shingling the samples. Failure to provide this results in the situation shown in FIG. 11 where the samples merely drape from a ring without spreader means and without freedom to dangle. As will be seen this is a clumsy, rigid arrangement inconvenient to utilize and less attractive in use.

Figure 13:
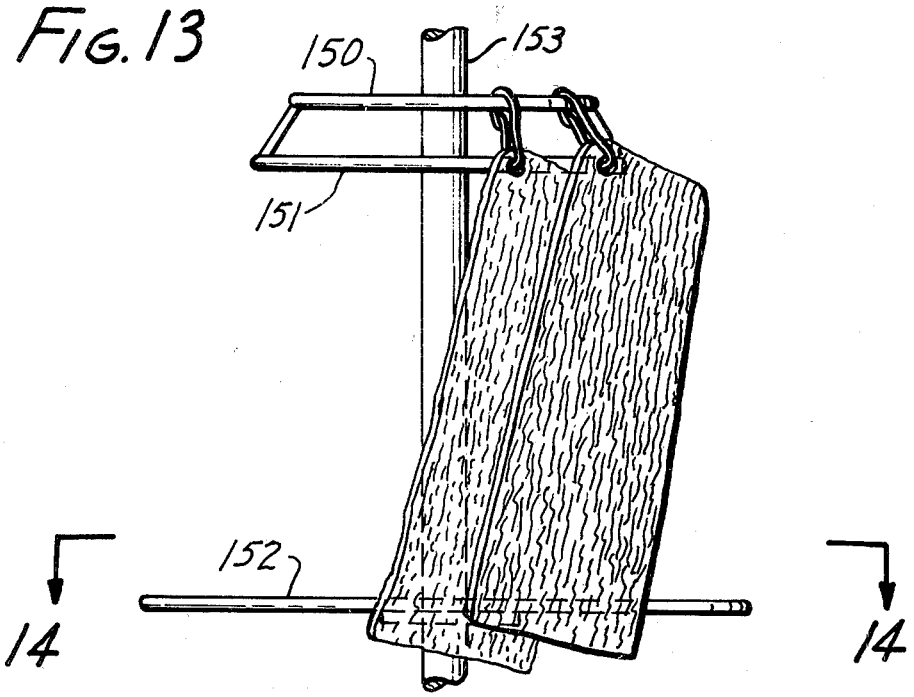
FIG. 13 is a side view of a modification.
Figure 14:
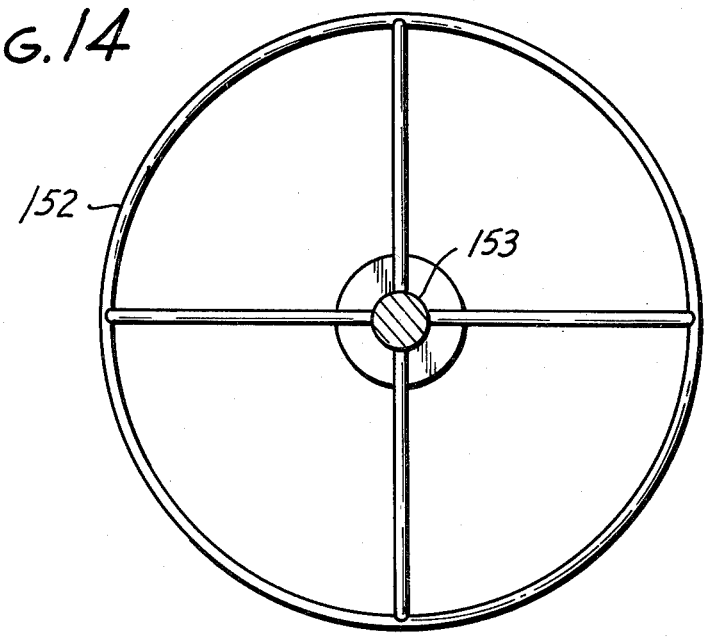
FIG. 14 is a cross-section taken at line 14—14 in FIG. 13.

FIGS. 13 and 14 show means for modifying the device so as to accommodate larger samples, for example $13\frac{1}{2} \times 18$ inches. A support ring 150 is at the top. A first spreader means 151 is disposed closely beneath it and it projects radially beyond it. Then a second spreader means 152 is disposed below means 151, perhaps 20 inches lower, and it also projects beyond it. The upper spreader means serves to spread out either the fasteners or the upper corners of the samples, depending on how long the fasteners are, and how far below the support ring the upper spreader means is placed. Sometimes it may be as close as two inches, and sometimes farther. The diameter of the lower spreader means is arbitrary, but will be greater than that of the upper spreader means. It should be sufficiently greater that a flaring out of the samples at the bottom is attained. The support ring and spreader means are attached to a spindle 153 by means similar to those in FIGS. 1–12, and similar fastener means are used.

Corner reinforcement means are not necessary to the enjoyment of this invention. In fact, in FIG. 10 the fasteners 55 are shown passing directly through a hole in the material itself. However, many users may not wish to go to the trouble of perforating or puncturing the carpet sample and the corner reinforcement members obviate such a necessity, because they can be prepunched.

Figure 15:
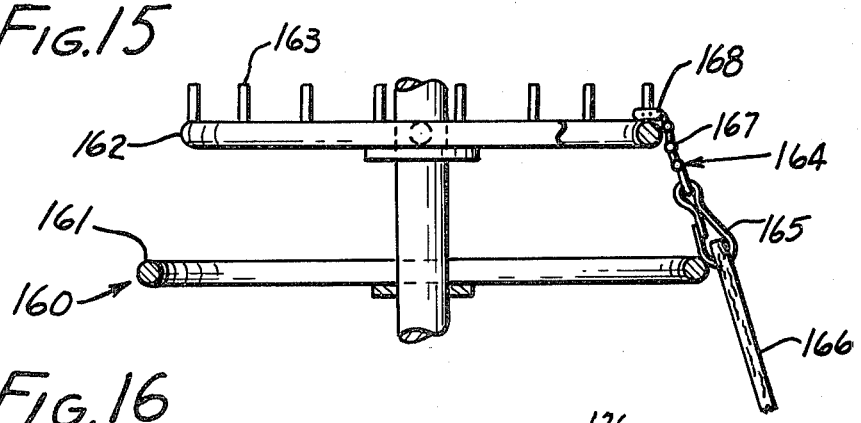
FIG. 15 shows another embodiment of support ring and attachment means.

FIG. 15 shows yet another embodiment of support structure 160. It has a lower spreader means 161 as in the previous embodiments. It differs in its support ring 162. This is a ring as before, but instead of requiring that attachment means be hooked onto the ring, the ring is provided with posts 163. Attachment means 164 includes a loop-shaped member 165 for attachment to sample 166, and also has a length of bead chain 167 with a ring 168 at its end. This ring is spindled onto a respective post. The sample is suspended from the support ring, and is spread out by one or more spreader means beneath it.

Figure 16:
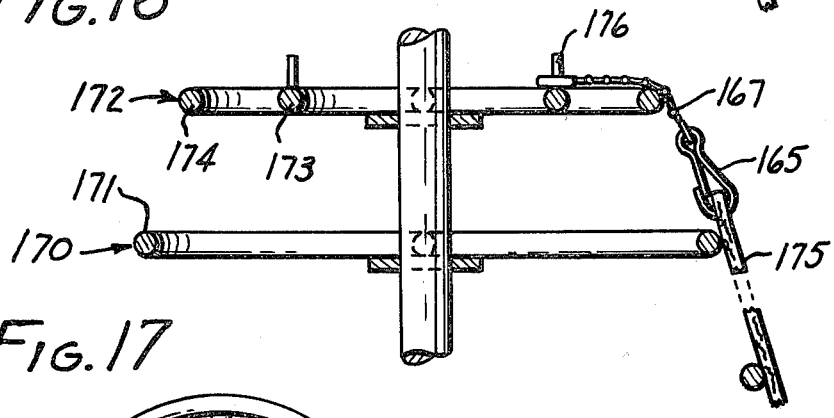
FIG. 16 shows still another embodiment of support ring and attachment means.

FIG. 16 shows another embodiment of the invention. Support structure 170 is mountable to a spindle as in the other embodiments. It has one or more lower spreader means 171, in this case a ring or rings. A support ring 172, instead of comprising a single ring to which the attachment means is attached and by which it is suspended, includes an inner ring 173 and an outer ring 174 in the same plane. Inner ring 173 is for attachment purposes, and outer ring 174 determines from what point the sample is suspended. The attachment means 164 of FIG. 15 is attached to a sample 175, and its ring is placed over a selected one of a number of posts 176 that project up from the inner ring. Considerable facility in mounting and removing the samples from the support structure is provided when the place of attachment and detachment is spaced from the point of suspension.

Attachment means 65, 66 shown in FIG. 12 is quite useful with the embodiment of FIG. 16. The inner ring need not include the posts (although it may) and loop-shaped portion 65 can be attached to the inner ring. The radial spacing between the inner and outer ring will be about equal to the length of loop-shaped member 65 so that clip 66 dangles from it beyond the outer ring.

Figure 17:
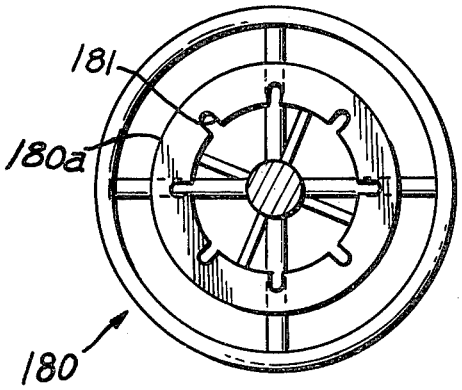
FIG. 17 is a top view of yet another embodiment of support structure.
Figure 18:
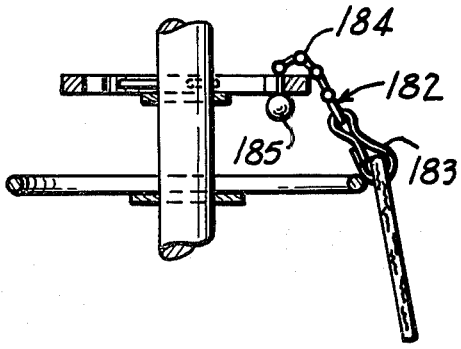
FIG. 18 is a fragmentary section view of FIG. 17.

FIGS. 17 and 18 show a variation of FIG. 16. Instead of providing two separate rings for support ring 180, a plate-like ring 180*a* is provided with notches 181 in its inside wall. Attachment means 182 has a loop-shaped member 183 (or clip if preferred), a bead chain 184, and an enlarged bead 185 on its end. The chain can be placed in a notch, but the bead will be trapped below it. This is a convenient means for attachment and detachment of the sample to the support structure.

Figure 19:
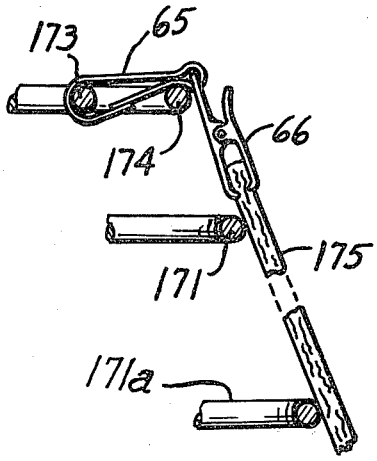
FIG. 19 is a fragmentary section view of the presently-preferred embodiment of the invention.

FIG. 19 shows the presently-preferred embodiment of the invention. It includes the two rings 173, 174 and spreader means 171 of the device of FIG. 16. The posts 176 are omitted. An additional spreader means 171*a* (one or more) can optionally be placed below the support ring. The attachment means of FIG. 12 is used. Element 65 is attached to ring 173, and just overhangs ring 174. Element 66 hangs from element 65, and does not reach to ring 171. Thus, the attachment means is attached to ring 173 and part of it dangles from element 65, the sample resting against spreader means 171 and any other spreader means which might be provided.

FIGS. 16–19 illustrate the advantage of providing a substantial radial dimension for the support ring. This facilitates the handling and shingling of the samples, and enables them to easily be raised out of the group without having to detach the attachment means. However, this is not a necessary feature.

All embodiments can be motorized to rotate the support structure on the spindle or even to rotate the spindle itself so the support members turn with it.

The disclosed structures have great versatility. Their dimensions can be selected appropriately to the size and number of samples to be displayed. For example, in the carpet art it is customary to make available larger "quality" samples for the customer to see texture and pattern, and smaller "color" samples where the color can be seen, but which are too small effectively to show pattern or texture.

The larger sample will require larger diameter support rings and spreader means, and frequently will require spreader support at more than one elevation. This can be provided by using more than one spreader means, or by providing the spreader means as the frustum of a cone with a substantial elevation.

Smaller samples will usually require only one spreader means, and larger samples two or more.

In all embodiments, the use of two rings (or a disc) for the support ring will provide important advantages in facility of handling the samples.

Because the samples are "fanned out" much like a hand of cards, the weight borne by any sample is relatively small. The cone angle of the stack is preferably not greater than about 60° included angle. A larger or smaller angle can be used, but the display may not be as attractive.

Dimensions are completely arbitrary. However, the nearest spreader means to the support ring will usually be below the support ring by about $\frac{2}{3}$ the longest side dimension of the sample to be displayed. The diameter of the support ring will be appropriate to the number of samples to be displayed. The support ring is often between about 3 and 8 inches in diameter, the spreader means about 3 inches larger in diameter, and when used for large samples, another spreader means is often used well below it, with a diameter between about 17 and 28 inches.

The construction of the device is simple. It may be made from wire as shown, or from any other desired material, so long as there is a means for the attachment means to be attached to the upper mounting ring.

This invention thereby provides an expedient, attractive, useful and relatively inexpensive means to multiply the effectiveness of the floor space of the store and to make available to the prospective customer a large collection of samples in a relatively small space.

This invention is not to be limited by the embodiments shown in the drawings and described in the description which are given by way of example and not of limitation, but only in accordance with the scope of the appended claims.

We claim:

1. A display system comprising:

a plurality of samples made of sheet-like pieces of relatively stiff material such as carpeting, having dimensions of length, width and diagonal, and a corner; an upright spindle having a central axis; sample support structure supported by said spindle comprising a substantially circular support ring and a substantially circular spreader ring extending around said axis, said support ring being disposed above said spreader ring, and said spreader ring projecting radially beyond said support ring, said structure being supported by said spindle attachment means for each of said samples, each attachment means comprising a fastener engaged to said support ring and to said corner of said sample, being angularly movable relative to one of said support ring and sample, whereby each said sample is linked to and hangs freely with its diagonal extending generally downwardly, and being supported by said spreader ring so as to be supported by hanging against it, and being releasably attached to said support ring or said sample whereby a plurality of said samples can hang from said support ring in a shingled and spread-out array around and against said spreader ring, and can be removed from the array by detachment of said fastener.

2. A display stand according to claim 1 in which stop means is interposed between said spindle and said support structure to support the latter at a selected elevation.

3. A display stand according to claim 2 in which said stop means comprises a cross-pin fitted in a hole in said spindle, and a plate attached to said support structure bearing against said cross-pin.

4. A display stand according to claim 1 in which said support structure includes bearing means providing lateral support against said spindle at axially spaced-apart locations whereby to limit tilting of said support structure relative to said central axis.

5. A display stand according to claim 1 in which a floor stand supports said spindle.

6. A display stand according to claim 1 in which said support ring comprises a pair of rings in substantially the same plane, one of said rings being within the other, whereby said attachment means can be attached to said inner one of said rings, and rest upon the outer one of them.

7. A display stand according to claim 6 in which said attachment means is bendable where it rests on said outer one of said rings.

8. A display stand according to claim 1 in which said fastener comprises a loop-shaped member adapted to be opened and closed.

9. A display stand according to claim 8 in which said attachment means further comprises a gripper means, said gripper means being attached to said loop-shaped member.

10. A display stand according to claim 1 in which a second said spreader ring is disposed below said first spreader ring and projects radially beyond said first spreader ring.

* * * * *